US005447769A

United States Patent [19]

Bromberg

[11] Patent Number: 5,447,769

[45] Date of Patent: Sep. 5, 1995

[54] DISK MOUNTING SYSTEM FOR WHEEL CALCULATOR THE LIKE AND METHOD OF MAKING SAME

[75] Inventor: Howard M. Bromberg, Riverdale, N.Y.

[73] Assignee: The Flexi/Group, Inc., Riverdale, N.Y.

[21] Appl. No.: 214,945

[22] Filed: Mar. 16, 1994

[51] Int. Cl.[6] ..... G09F 11/04

[52] U.S. Cl. ..... 428/66.6; 428/136; 428/138; 40/495; 235/78 R

[58] Field of Search ..... 428/65, 136, 138; 40/495; 235/78 R, 78 M, 78 A, 78 F, 78 G, 78 N, 78 RC

[56] References Cited

U.S. PATENT DOCUMENTS

| | | | |
|---|---|---|---|
| 784,974 | 3/1905 | Biggs | 40/495 |
| 1,530,404 | 3/1925 | Pearce | 40/495 |
| 1,715,737 | 6/1929 | Bradley | 40/495 |
| 2,016,445 | 10/1935 | Masseyge | 40/495 |
| 2,386,082 | 10/1945 | Attridge | 235/122 |
| 2,932,104 | 4/1960 | Corbett | 40/495 |
| 3,103,080 | 9/1963 | Desmond | 40/495 |
| 3,194,717 | 7/1965 | Albert | 161/113 |
| 3,321,858 | 5/1967 | Bailey | 40/70 |
| 3,468,037 | 9/1969 | Warneke | 40/495 |
| 3,471,956 | 10/1969 | Walters | 40/495 |
| 3,604,134 | 9/1971 | Clark | 40/495 |
| 3,718,519 | 2/1973 | Montgomery | 156/250 |
| 3,852,900 | 12/1974 | Svec | 40/495 |
| 3,939,586 | 2/1976 | Clark | 40/495 |
| 4,008,533 | 2/1977 | Greenberger | 40/495 |
| 4,323,609 | 4/1982 | Bromberg | 428/65 |

*Primary Examiner*—Alexander S. Thomas
*Attorney, Agent, or Firm*—Herbert Dubno

[57] ABSTRACT

A disk is mounted upon a substrate of sheet material with a separate piece also of sheet material secured to the substrate and having at least a pair of strips overhanging the disk and of a length sufficient to lie flat thereagainst. The strips define a number of points at which the inner circumference of the disk is engaged and with a spacing a=Dsin (180°/n)±25% where D is the diameter of the opening and n is the number of disk overhanging strips. When two strips are provided the applicable formula is a=Dsin (180°/4)±25% where D is said diameter of said opening.

22 Claims, 7 Drawing Sheets

DISK MOUNTING SYSTEM FOR WHEEL CALCULATOR THE LIKE AND METHOD OF MAKING SAME

FIELD OF THE INVENTION

My present invention relates to a wheel mounting system for disk calculators and the like and to a method of making same.

BACKGROUND OF THE INVENTION

The mounting of a disk on a paper substrate is widely used in many fields, e.g. in the disk calculator field in which a disk of sheet material is rotatably mounted on a substrate or within a sleeve to display information through a window in the substrate or cover sheet or at an edge of the article, as a wheel for an article having the configuration of a vehicle in a toy, advertising piece or educational piece, as a rotatable member in a pop up card or book, and in a variety of other applications.

A number of techniques have been provided for mounting the disk on the substrate, the most common of which may be the passage of a spreadable paper fastener or rivet or eyelet through aligned holes in the disk and the substrate.

However, numerous other techniques have been developed when employment of an eyelet or paper fastener is undesirable for economy, safety or convenience.

For example, in my U.S. Pat. No. 4,323,609 of 6 Apr. 1982, I have described a rotatable wheel assembly in which the rotatable disk is mounted upon a substrate, inter alia, by a plurality of tabs which are pressed out of the substrate, pass through an opening in the disk and engage in an opening of the cover member to define a structure between the substrate and the cover member upon which the disk is rotatable.

Other techniques are known in the art as well.

For example, U.S. Pat. No.2,386,082 of 2 Oct. 1945, describes a mounting for a disk in which tabs of a substrate are bent back over the inner perimeter of a disk. A system utilizing two instead of four tabs is described in U.S. Pat. No. 3,321,858 of 30 May 1967, these tabs being lifted from the plane of the substrate and overhanging the inner circumference of the disk which, for this purpose, has an internal diameter less than the diameter of the peripheries of these tabs.

In U.S. Pat. No.1,715,737 of 4 Jun. 1929, the pivot is formed by a pronged fastener permanently attached to the substrate, the prongs of which are passed through a central hole in the disk.

In U.S. Pat. No.3,604,134 of 14 Sep. 1971, the pivot for the disk is formed by a central region thereof broken away from the outer portion of the disk. A similar mounting is provided in U.S. Pat. No.3,939,586 of 24 Feb. 1976.

The mounting for the wheel or disk or the calendar of U.S. Pat. No.2,932,104 is formed by a separate central disk attached by adhesive to the substrate and the cover member.

In U.S. Pat. No.3,103,080 of 10 Sep. 1993, widely spaced tabs are lifted from the substrate to overhang the inner circumference of the disk whose internal diameter is less than the spacing of the tabs.

The price marker of U.S. Pat. No.4,008,533 issued 22 Feb. 1977 provides a disk which can have outwardly deflectable tabs engaging in an opening of the support to journal the disk on the latter. In U.S. Pat. No.2,016,445, bent back tabs engage around the inner circumference of the disk.

A separate bearing piece is secured between the substrate and the cover member in U.S. Pat. No.3,718,519 of 27 Feb. 1973 and is heat sealed in position.

U.S. Pat. No.3,852,900 provides a bearing between male and female formations of the cover and substrate which interfit on assembly and journal the disk or wheel.

In U.S. Pat. No.3,471,956, tabs of the substrate or disk are bent through openings in the other and in U.S. Pat. No.3,468,037, a similar principle is used.

By and large, therefore, the prior art provides a rotatable mounting for a disk or wheel which pushes relatively short tabs through openings in either the support or the wheel so that these tabs project in a manner which makes a flat structure difficult to achieve or creates a problem for stability of the wheel, or provides a central structure bearing structure necessitating complex elements which must be positioned with considerable effort. In some cases the cost of the mounting may preclude use of the particular structure for some applications while in others lack of stability, lack of flatness and the need for additional elements may preclude widespread use of the assemblance method or technique.

OBJECTS OF THE INVENTION

It is, therefore, the principal object of the present invention to provide an improved wheel mounting assembly for wheel calculators, wheel-type promotional and informational devices, wheel-type toys and games, wheel-type displays, pop-ups and the like and, in general, wherever a flat wheel or disk is to be mounted upon a flat support or substrate whereby drawbacks of prior art assemblies are avoided.

A more specific object of the invention is to provide a low cost disk mounting assembly for wheeled devices of paper, paper board and like sheet materials which can provide for accurate and reliable rotation and positioning of the disk relative to the substrate.

It is also an object of the invention to provide an improved method of making such a wheeled assembly.

SUMMARY OF THE INVENTION

I have discovered that the drawbacks of the prior art systems outlined above can be overcome by the provisions of a positioning and journaling system for a disk of sheet material which utilizes two or more elongated strips which are continuous with one another, which after passing through the hole in the disk or wheel can lie flat against the disk or wheel and thus should extend say halfway across the width of the disk between its inner and outer circumferences, and should have lengths which exceed the width of these strips. The strips, while being continuous (in one piece) with one another should be formed as a piece separate from the substrate while being attached thereto and, advantageously, a cover sheet should be applied over the strips and can be bonded thereto or to the substrate or attached to the substrate at a location other than the strips as may be desired.

In general, the disk or wheel will project beyond an edge of the substrate to allow the disk to turn or to be turned. When the disk is an information carrier information thereon can be read through a window in the substrate in the wheel itself or in the cover in two or more of these elements or at an exposed periphery of the wheel or disk.

When reference is made herein to sheet material, I intend to thereby include any flat material which may be utilized in a wheel calculator, information carrier, display or toy, usually of paper, paper board, cardboard, a plastic sheet, plastic coated paper or the like. More particularly, the wheel assembly can comprise:

a substrate composed of sheet material;

at least two elongated strips of sheet material continuous with one another, separate from the substrate, and affixed to the substrate, the strips forming at least three points at vertices of a polygon which can be circumscribed by a circle of a given diameter; and an annular disk of sheet material having a central opening of an inner diameter corresponding to the given diameter and mounted upon the substrate by the strips so that the strips pass through the opening and extend over the disk for lengths exceeding a spacing between the vertices, thereby enabling rotation of the disk centered by engagement of an inner periphery thereof at the points.

The strips can extend circumferentially from a central web and can be connected by bends thereto, the central web being secured to the substrate to define the points or corners of the web. Alternatively, the strips can protrude through slits in the substrate from a side thereof opposite the side at which the disk is mounted.

The web can be secured by a bridge strip across the web or four strip arms can extend at right angles to one another from the web and wherein two of the strips are provided diametrically opposite one another and the points are spaced regularly from one another by a distance $a=D\sin(180°/4)\pm25\%$ where D is the diameter of the opening.

At least three regularly spaced strips can be continuous with one another and pass through the opening to hold the disk on the substrate.

According to a feature of the invention the points are spaced regularly from one another by a distance $a=D\sin(180°/n)\pm25\%$ where D is said diameter of said opening and n is the number of said strips.

The method of mounting an annular disk with a central opening of a given inner diameter upon a substrate can comprise the steps of:

(a) providing upon a substrate of sheet material at least two elongated strips of sheet material continuous with one another, separate from the substrate, and affixed to the substrate, the strips at the substrate forming at least three points defining vertices of a polygon which can be circumscribed by a circle of a diameter corresponding to the inner diameter; and (b) mounting the annular disk upon the substrate so that the strips pass through the opening and extend outwardly over the disk for a length exceeding a spacing between the vertices, thereby enabling rotation of the disk centered by engagement of an inner periphery thereof at the points.

In another aspect of the generic invention, a wheel assembly can comprise:

a substrate composed of sheet material;

at least two elongated strips of material connected by respective fold lines with the substrate and extending from a surface of the substrate, the fold lines being separated by a web of the substrate located between the fold lines, the strips forming at least three points at vertices of a polygon which can be circumscribed by a circle of a given diameter; and an annular disk of sheet material lying against the surface, having a central opening of an inner diameter corresponding to the given diameter, and mounted so that the strips pass through the opening and extend over the disk, thereby enabling rotation of the disk centered by engagement of an inner periphery thereof at the points.

The strips can then be flaps which are cut directly out of the substrate leaving the aforementioned web between them.

Unlike systems in which a central opening or slit is provided to define tabs which can be pressed out and folded back over the disks, the use of two or more strips interconnected by a common web, forming part of the original substrate or affixed to the substrate as a separate member, allows the strips to extend away from their connecting web without having to be folded through 180° at the fold line.

BRIEF DESCRIPTION OF THE DRAWINGS

The above and other objects, features, and advantages will become more readily apparent from the following description, reference being made to the accompanying drawing in which.

SPECIFIC DESCRIPTION

Figure 1:
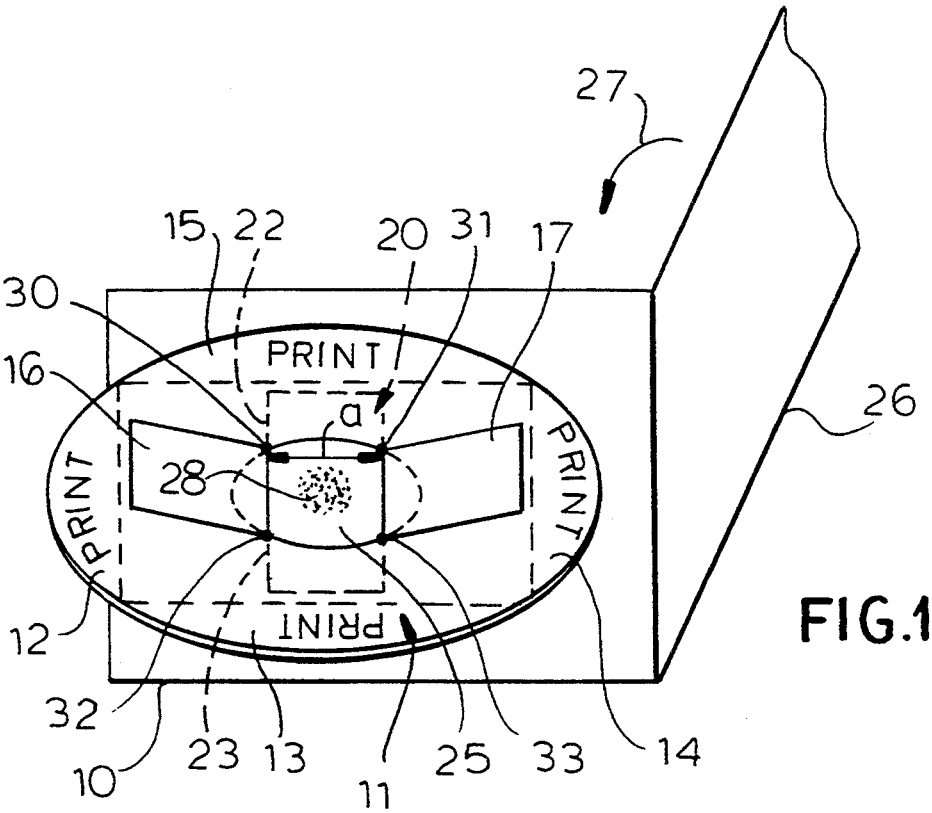
FIG. 1 is a perspective view showing a wheeled unit in accordance with the invention prior to the attachment for the cover member thereon.
Figure 2:
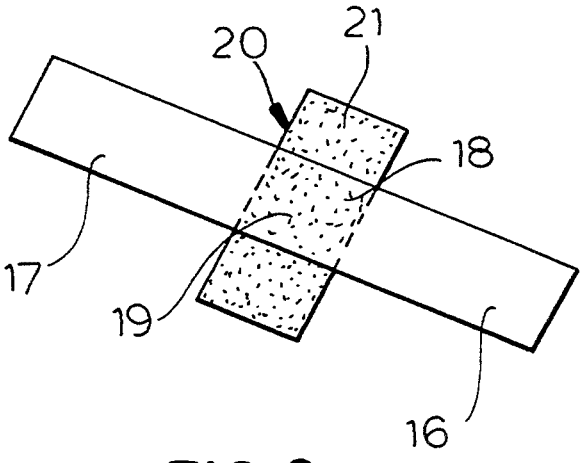
FIG. 2 is a perspective view from the underside of a strip unit which can be mounted upon a substrate utilizing the principles illustrated in FIG. 1.
Figure 4:
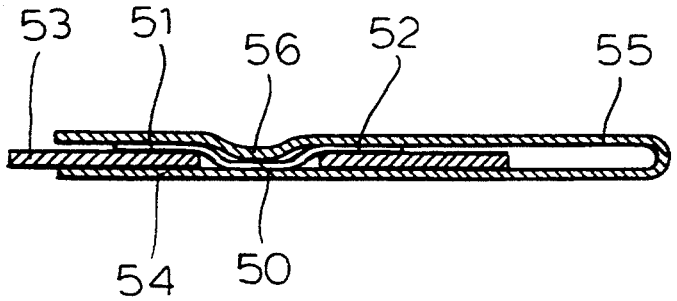
FIG. 4 is a cross sectional view illustrating the invention.

In FIG. 1 I have shown a wheel calculator, advertising display or the like which comprises a substrate 10 of sheet material, e.g. paper which may or may not be plastic coated and which may be printed on its side not shown with information relating to the information contained on a disk 11 to be mounted on that substrate. The disk 11 is also composed of sheet material and, in the embodiment illustrated, is printed with fields 12, 13, 14 and 15 selectively displayed at the edge of the article upon rotation of that disk. The disk 11 is rotatably mounted upon the substrate 10 by an assembly as shown in FIG. 2 which constitutes two strips 16 and 17 continuous with one another at a web 18 which may be square in outline and which is provided with an adhesive 19 capable of bonding to the substrate 10. The web 18 can be covered by a bridge band or strip 20 which also may be provided with adhesive material at 21 to enable it to bond to the web 18 and to provide adhesive tabs 22 and 23 which additionally secure the strips 16 and 17 to the substrate 10.

The strips 16 and 17 pass through the central opening 25 in the disk 15 and overlay the disk as shown in FIG. 1 while lying flatly thereagainst when a cover member 26 is folded down into position (arrow 27) and secured to an adhesive spot 28 on the upper surface of the bond 20 shown in FIG. 1. Other means for securing the cover 26 to the substrate 10 may, of course, also be provided and, when a plurality of wheels are disposed within an article, mounted by the assembly 16, 17, etc. The attachment of the cover can be effected via means completely independent of the means for rotatably mounting the wheels.

Alternatively, the cover member could be a patch lying wholly within the periphery of the wheel and secured at the assembly 16, 17.

The strips 16, 17, the band 20 and the web 18 define four points 30, 31, 32 and 33 at which the disk 14 is rotatably supported on the substrate, these points lying at the vertices of a rectangle, preferably a square. According to the invention, for a two strip support, the spacing a between the vertices should correspond to $a=D\sin(180°/4)\pm25\%$ where D is said diameter of said opening of the opening 25.

Figure 3:
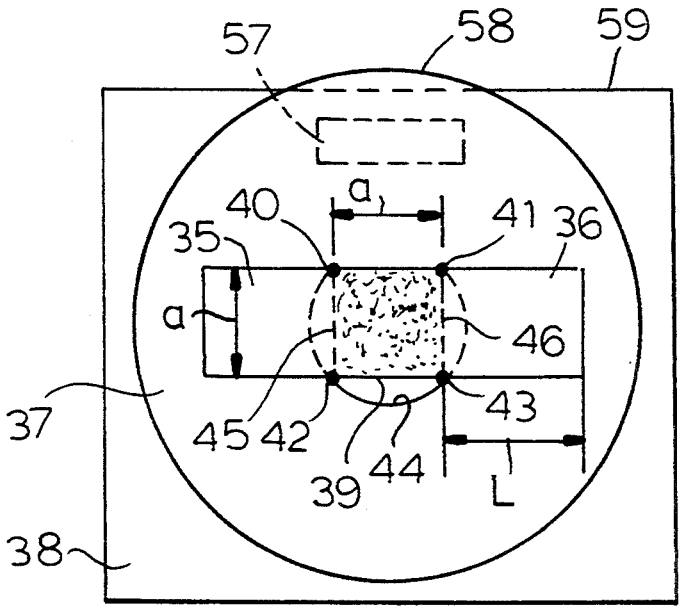
FIG. 3 is a plan view showing another strip arrangement according to the invention.

A similar mount can be provided as shown in FIG. 3 with two strips 35 and 36 overhanging the disk 37 on the substrate 38. Here, the web 39 is bonded to the substrate 38 without the bridge band 20 but still defines the points 40, 41, 42 and 43 at which the inner circumference of the central opening 44 of the disk is rotatably engaged. The distance a between these vertices corresponds to the width of the strips 35 and 36 and the length of each strip from its bend 45 or 46 connecting it with the web 39 is represented at L and is equal at least to $\underline{a}$.

Figure 6:
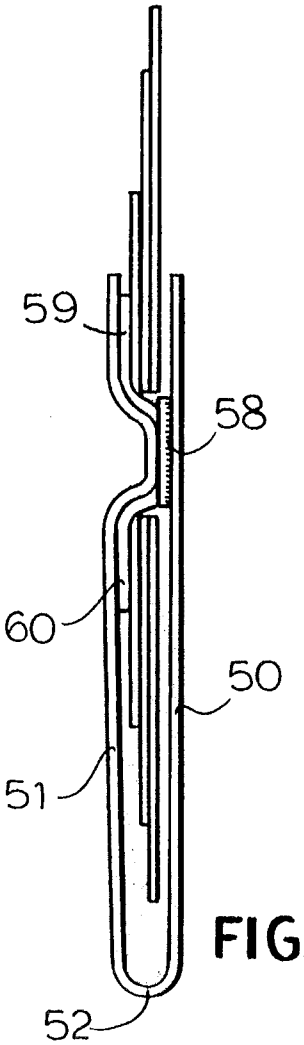
FIG. 6 is a cross sectional view taken along the line VI—VI of FIG. 5 but with the thicknesses of the various sheet material elements exaggerated and the spacings of the elements exaggerated so that the wheel will appear to have a thickness greater than its actual thickness.
Figure 5:
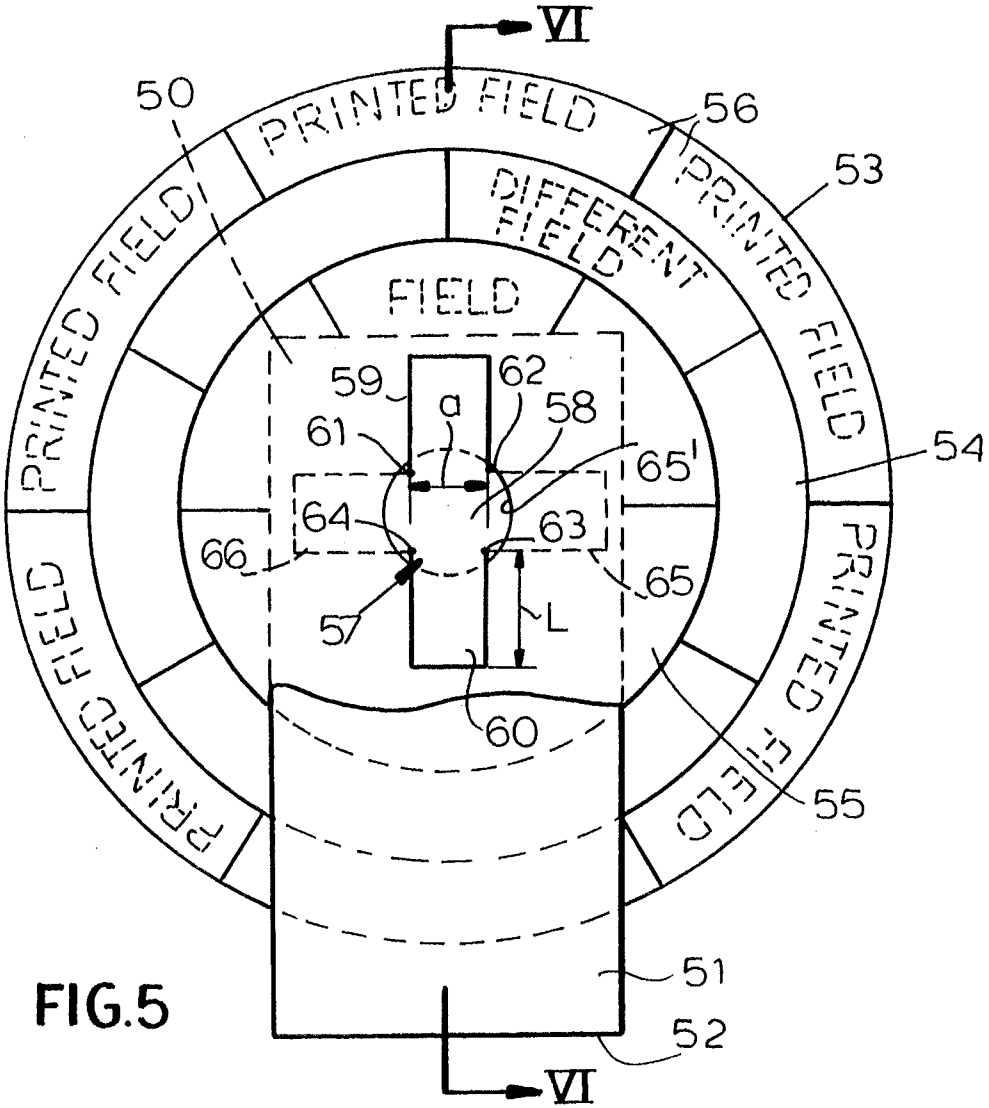
FIG. 5 is a diagrammatic elevational view of a calculator or like wheel according to the invention illustrating an embodiment similar to FIGS. 1–4 but wherein the bridge piece is not used but the strips are arms which alternate with one another above and below the multiple disks here used.

From FIGS. 5 and 6, it will be apparent that a multiplicity of disks or wheels can be provided in a wheel calculator or the like utilizing the same principles.

Here the substrate 50 is connected to the cover sheet 51 by a fold 52 with an exaggerated separation in FIG. 6 to allow the thicknesses of the various elements also to be exaggerated for clarity.

In this embodiment, three disks 53, 54 and 55 are provided in coaxial relationship, the disks being of progressively smaller diameters and being subdivided in printed fields 56 which can be aligned with one another or with windows in the substrate or cover sheets to convey different information depending upon the alignments. The disks are rotatably mounted by a cruciform-shaped member 57 having a central web 58 adhesively attached to the substrate and two arms 59 and 60, diametrically opposite one another and continuous with one another through the web 58, which reach over the three disks 53–55 to overlie the latter with a length L greater than the spacing a of the points at which the disks are rotatably supported, these points being represented at 61, 62, 63 and 64. The two arms or strips 65 and 66 at right angles to the strips 59 and 60 are continuous therewith and may be adhesively bonded to the substrate while the central web is not. Alternatively or in addition the central web can be bonded to the substrate and not the arms 65 and 66.

The cover sheet 51 can be attached by adhesive web 58 or to the strips 59, 60. Here the distance a is given by the relationship $\underline{a}=D\sin(180°/4)\pm25\%$ where D is the diameter of the openings 65' in the disks and n, i.e. number of arms or strips, is 4. The widths of the arms 65, 66 may be different from the widths of the strips 59 and 60 if desired.

Figure 7:
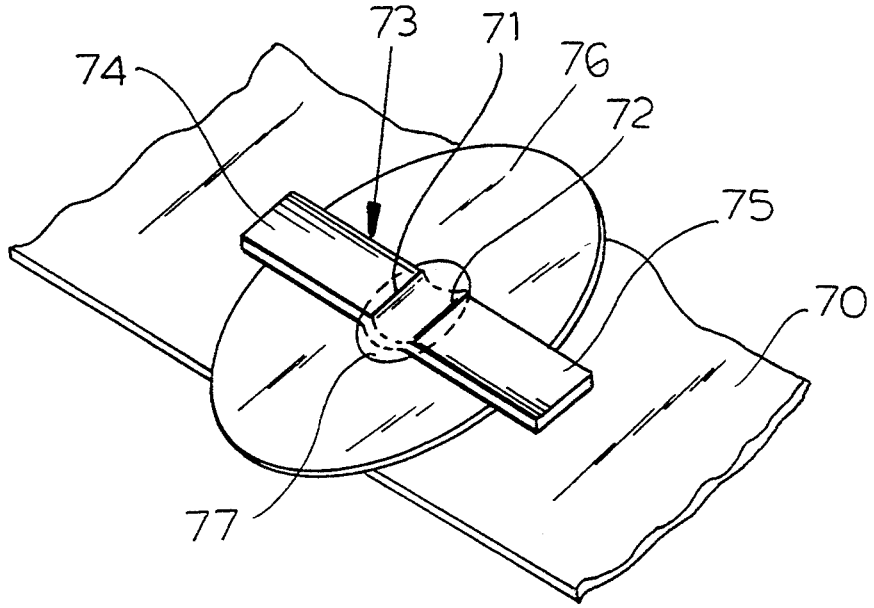
FIG. 7 is a perspective view illustrating yet another embodiment of a wheel unit according to the invention.

As can be seen from FIG. 7, the substrate 70 can be provided with slits 71 and 72 through which a strip 73 can be passed, that the arms 74 and 75 overlie the disk 76 and determine four points of rotatable support for the inner periphery of the opening 77 and this disk is analogous to the support points 40–42 of FIG. 3.

Figure 8:
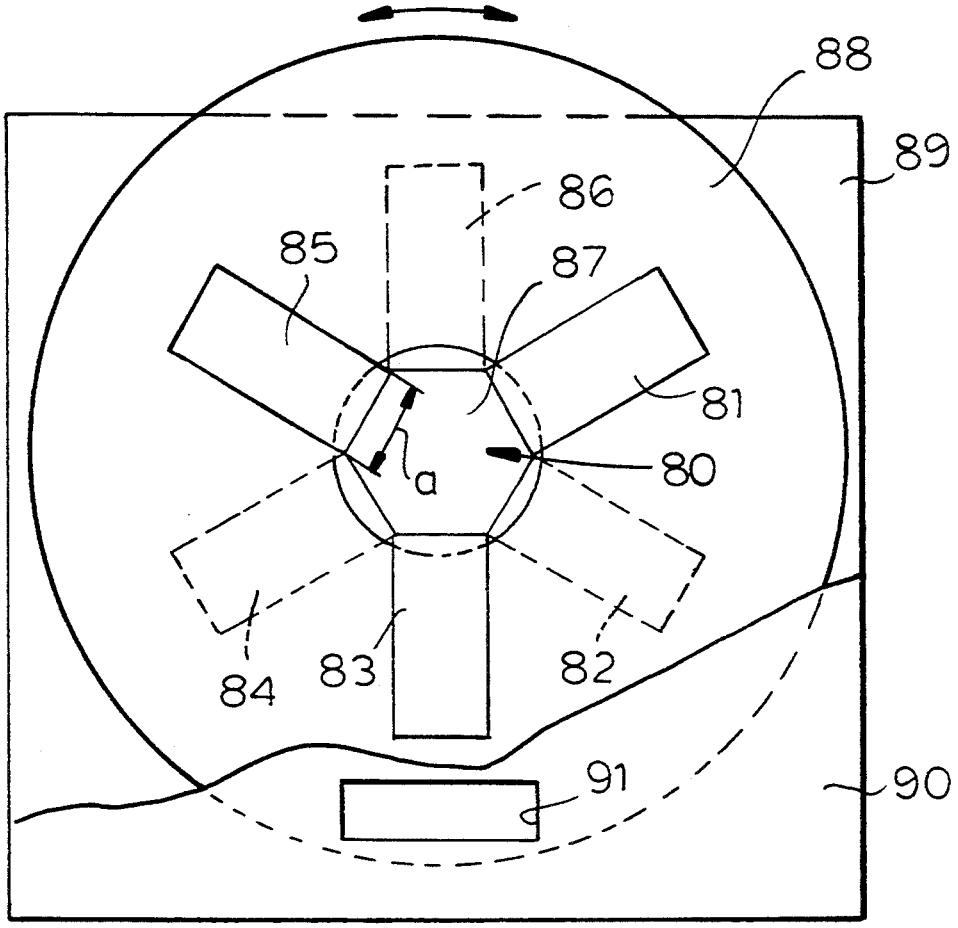
FIG. 8 is a diagrammatic elevation partly broken away, showing a multiple arm unit for securing a disk to a substrate.

While the embodiment of FIG. 8 is less practical, FIG. 8 shows the principle of this invention as applied to a mounting piece 80 having a multiplicity of strips or arms 81–86 angularly equispaced (within the manufacturing tolerances) with respect to one another, extending from a central web 87 and alternating above and below the disk 88, the web 87 and the strips 82, 84, 86 being adhesively bonded to the substrate 89 whose cover sheet 90 can have a window 91 through which legible matter on the disk 88 can be viewed. Here the number of strips 81–86 is 6 (n=6) and the distance a between support points is given by $\underline{a}=D\sin(180°/6)\pm25\%$ where D is the diameter of the opening 92 in the disk.

Figure 9:
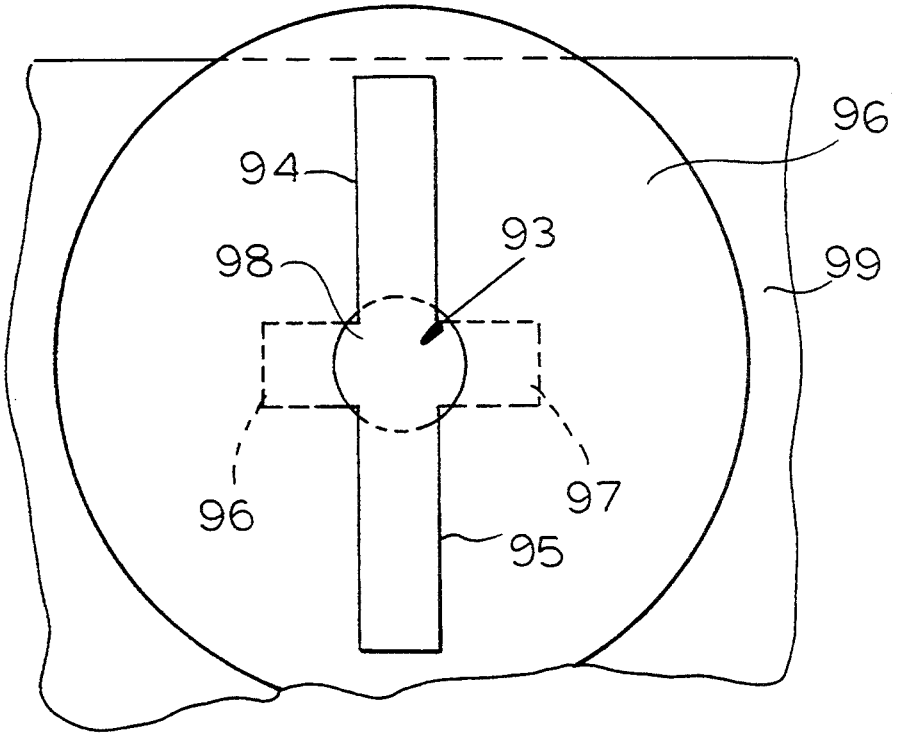
FIG. 9 is a view generally similar to FIG. 8 and yet another embodiment.

FIG. 9 shows an embodiment in which the disk retention member 92 is of cruciform shape as in FIG. 5, but the strip arms 94 and 95 overlying the disk 96 are substantially longer than the strip arms 96 and 97 secured with the web 98 to the substrate 99.

Figure 10:
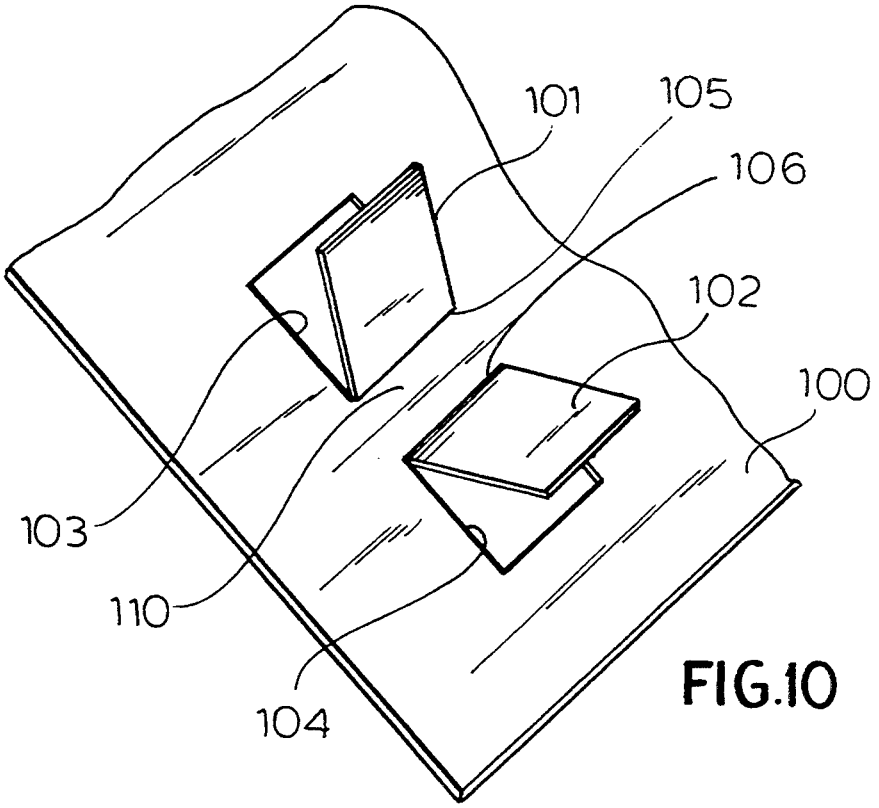
FIG. 10 is a perspective view illustrating an embodiment wherein the strips are formed in one piece with the substrate and the web connecting the strips.

In FIG. 10, I have shown a substrate 100 of sheet material from which two strips 101 and 102 are cut directly, leaving windows 103 and 104 directly in the substrate. The strips 101 and 102 are connected at fold lines 105, 106 with the substrate 100 and, as shown in FIG. 11, one or more disks 107, 108 with aligned central openings 109 may be mounted by the strips 101, 102 upon the sheet 100.

Between the strips 101, 102 there is a web 110 of the material of the substrate and the strips 101, 102 extend away from that web without being folded over through 180° and in opposite directions from one another, i.e. the strips 101, 102 do not originally or after insertion through the openings 109 in the disk or disks extend toward one another.

Figure 11:
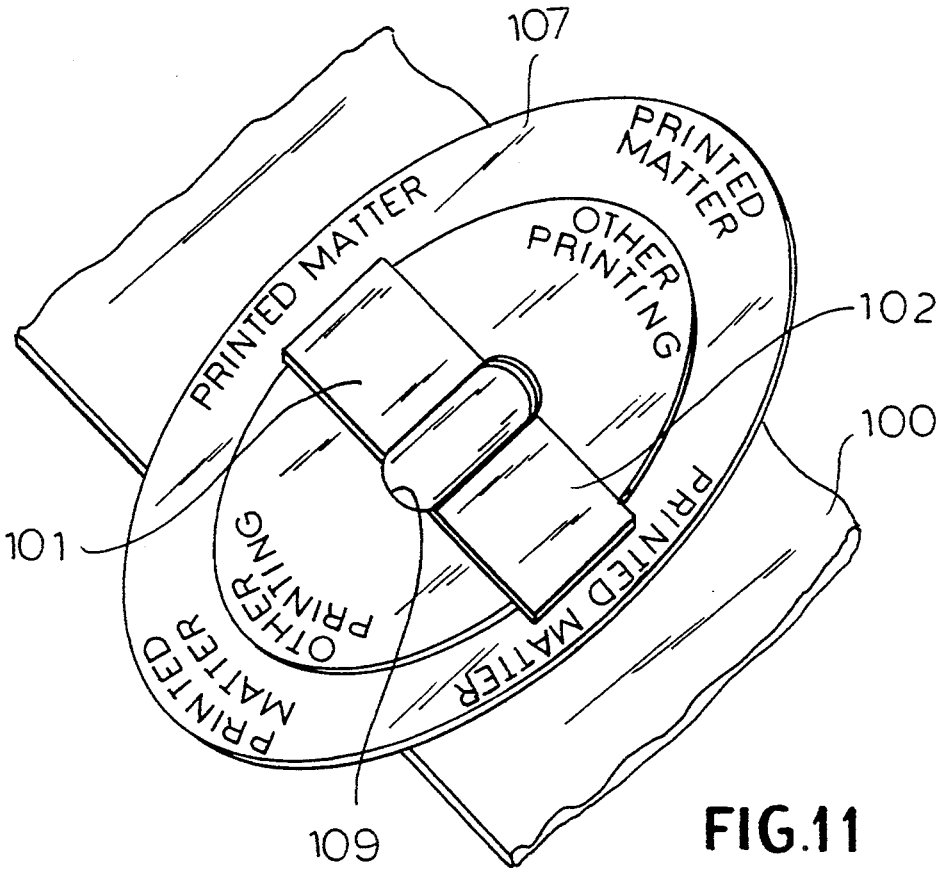
FIG. 11 is a perspective view of the embodiment of FIG. 10 provided with two strips holding 2 disks in place.

The disks can be provided with printed matter fields 111, 112 which can be revealed through openings in a cover leaf or at the edge of the calculator as may be desired, and the windows 103, 104 may be covered by a back connected by a fold to the substrate portion 100 visible in FIGS. 10 and 11.

Figure 12:
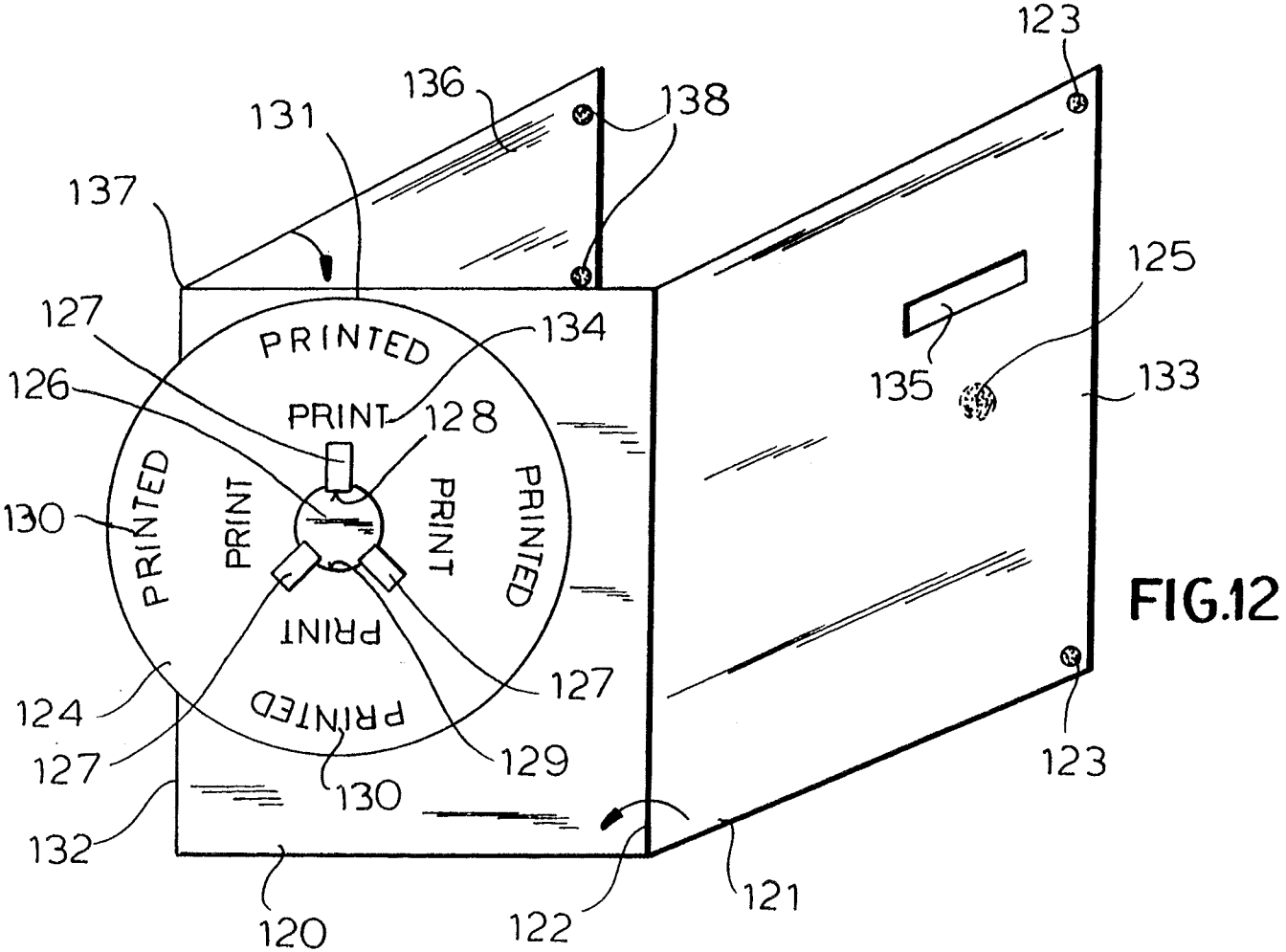
FIG. 12 is a plan view of an embodiment in which three strips cut out of a substrate and angularly equispaced from one another overlie the disk.

Another embodiment is shown in FIG. 12 where the substrate 120 or sheet material has a cover 121 connected to it by a fold line 122 and adapted to be affixed to the substrate 120 by one or more spots of glue or adhesive 123 engaging the surface of the substrate 120 outside the outer perimeter of a disk 124, or a glue or adhesive spot 125 adapted to bond to the web 126.

Since the retaining strips 127 are here cut directly from the substrate 120 and are connected thereto and to the web 126 at the fold lines 218, the web 126 remains intact. In this embodiment, moreover, three angularly equispaced strips are provided and form the points at which the inner periphery 129 of the disk 124 is rotatably engaged.

The disk 124 can have printed fields 130 along the outer periphery 131 and visible over the edges 132 and 133 of the calculator when the sheet 121 is folded over the substrate 120. Furthermore, an inner set of fields 134 of printed matter can be viewed through a window 135 in the cover sheet 121.

A rear flap 136 can be connected at a fold line 137 coinciding with the edge 132 to form the back of the wheel calculator and cover the openings left by cutting of the strips 127 from the substrate 120. Adhesive spots 138 can bond the flap 136 in place.

I claim:

1. A method of mounting an annular disk having a central opening with a given inner diameter upon a substrate, comprising the steps of:

(a) providing upon a substrate of sheet material at least two elongated strips of sheet material continuous with one another, separate from said substrate, and affixed to said substrate, said strips at said substrate forming at least three points defining vertices of a polygon which can be circumscribed by a circle of a diameter corresponding to said inner diameter; and (b) mounting said annular disk upon said substrate so that said strips pass through said opening and extend outwardly over said disk for a length exceeding a spacing between said vertices, thereby enabling rotation of said disk centered by engagement of an inner periphery thereof at said points, said strips being threaded through slits formed in said substrate.

2. The method defined in claim 1 wherein at least three of said strips are disposed regularly about an axis of said disk and said points are spaced regularly from one another by a distance $a=D\sin(180°/n)\pm25\%$ where D is said diameter of said opening and n is the number of said strips.

3. The method defined in claim 1 wherein two said strips are provided diametrically opposite one another and said points are spaced regularly from one another by a distance $a=D\sin(180°/4)\pm25\%$ where D is said diameter of said opening.

4. The method defined in claim 1, further comprising applying a cover sheet over the surface of said substrate upon which said disk is mounted.

5. The method defined in claim 4, further comprising the step of bonding said cover sheet to said strips.

6. A wheel assembly, comprising:

a substrate composed of sheet material;

at least two elongated strips of sheet material continuous with one another, separate from said substrate, and affixed to said substrate, said strips forming at least three points at vertices of a polygon which can be circumscribed by a circle of a given diameter; and an annular disk of sheet material having a central opening of an inner diameter corresponding to said given diameter and mounted upon said substrate by said strips so that said strips pass through said opening and extend over said disk for lengths exceeding a spacing between said vertices, thereby enabling rotation of said disk centered by engagement of an inner periphery thereof at said points, said strips protruding through slits in said substrate from a side thereof opposite a side of said substrate at which said disk is mounted.

7. The wheel assembly defined in claim 6 wherein said points are spaced regularly from one another by a distance $a=D\sin(180°/n)\pm25\%$ where D is said diameter of said opening and n is the number of said strips.

8. The wheel assembly defined in claim 6 wherein two said strips are provided diametrically opposite one another and said points are spaced regularly from one another by a distance $a=D\sin(180°/4)\pm25\%$.

9. The wheel assembly defined in claim 6, further comprising a cover sheet overlying said substrate and at least partly overlying said disk.

10. The wheel assembly defined in claim 9 wherein at least one of said substrate, said disk and said cover sheet is provided with at least one window enabling viewing of an information field on said substrate therethrough.

11. A method of mounting an annular disk having a central opening with a given inner diameter upon a substrate, comprising the steps of:

(a) applying with an adhesive to a substrate of sheet material a mounting web of sheet material having at least two elongated strips of sheet material continuous with and in one piece with one another and with said web, separate from said substrate, and affixed to said substrate, said strips at said substrate forming at least three points defining vertices of a polygon which can be circumscribed by a circle of a diameter corresponding to said inner diameter, said web having a width between said strips substantially corresponding to a width of said strips; and (b) mounting said annular disk upon said substrate so that said strips pass through said opening and extend outwardly over said disk for a length exceeding a spacing between said vertices, thereby enabling rotation of said disk centered by engagement of an inner periphery thereof at said points.

12. The method defined in claim 11 wherein at least three of said strips are disposed regularly about an axis of said disk and said points are spaced regularly from one another by a distance $a=D\sin(180°/n)\pm25\%$ where D is said diameter of said opening and n is the number of said strips.

13. The method defined in claim 11 wherein two said strips are provided diametrically opposite one another and said points are spaced regularly from one another by a distance $a=D\sin(180°/4)\pm25\%$ where D is said diameter of said opening.

14. The method defined in claim 11 wherein said web is adhesively bonded to said surface substantially over an entire area of said web.

15. The method defined in claim 11, further comprising the step of bonding a cover sheet overlying said disk to said strips.

16. The wheel assembly defined in claim 11 wherein a multiplicity of regularly spaced strips are continuous with one another and said web, said strips alternating with one another on opposite sides of said disk.

17. A wheel assembly, comprising:

a substrate composed of sheet material;

at least two elongated strips of sheet material continuous with one another, separate from said substrate, and adhesively affixed to said substrate by a central web formed in one piece with said strips and disposed between them, said strips forming at least three points at vertices of a polygon which can be circumscribed by a circle of a given diameter, said web having a width between said strips substantially corresponding to a width of said strips; and an annular disk of sheet material having a central opening of an inner diameter corresponding to said given diameter and mounted upon said substrate by said strips so that said strips pass through said opening and extend over said disk for lengths exceeding a spacing between said vertices, thereby enabling rotation of said disk centered by engagement of an inner periphery thereof at said points.

18. The wheel assembly defined in claim 17 wherein said strips extend diametrically from said central web and are connected by bends thereto, said central web defining said points as corners of said web.

19. The wheel assembly defined in claim 18 wherein said points are spaced regularly from one another by a distance $a=D\sin(180°/n)\pm25\%$ where D is said diameter of said opening and n is the number of said strips.

20. The wheel assembly defined in claim 17 wherein two said strips are provided diametrically opposite one another and said points are spaced regularly from one another by a distance $a=D\sin(180°/4)\pm25\%$.

21. The wheel assembly defined in claim 17, further comprising a cover sheet overlying said substrate and at least partly overlying said disk.

22. The wheel assembly defined in claim 21 wherein at least one of said substrate, said disk and said cover sheet is provided with at least one window enabling viewing of an information field on said substrate therethrough.

* * * * *